United States Patent [19]

Karlovich

[11] Patent Number: 4,990,105

[45] Date of Patent: Feb. 5, 1991

[54] TAPERED LEAD-IN INSERT FOR A COAXIAL CONTACT

[75] Inventor: Robert J. Karlovich, Mechanicsburg, Pa.

[73] Assignee: AMP Incorporated, Harrisburg, Pa.

[21] Appl. No.: 531,204

[22] Filed: May 31, 1990

[51] Int. Cl.[5] ..... H01R 13/00

[52] U.S. Cl. ..... 439/578

[58] Field of Search ..... 439/578–585

[56] References Cited

U.S. PATENT DOCUMENTS 3,699,504 10/1972 Huber ..... 339/177 R 3,858,156 12/1974 Zarro ..... 439/583

4,619,496 10/1986 Forney, Jr. et al. ..... 439/585

*Primary Examiner*—Joseph H. McGlynn

*Attorney, Agent, or Firm*—David L. Smith

[57] ABSTRACT

There is disclosed a coaxial contact for termination to a coaxial cable. The coaxial contact has an electrically conductive shell defining an open forward end (116). A center contact (56) for termination to a center conductor (208) of the cable has a mating portion defining cantilever beam means (60) extending to respective distal ends (54). The center contact (56) is disposed concentrically within and isolated from shell (104) by a first dielectric insert (26). A second dielectric insert (192) having a forward portion (232) and a rearward portion (234) is secured in the shell proximate the forward end (116). The second insert (192) has an axial bore (220) therein for receiving a center pin contact of a mating connector. The rearward portion receives within bore (220) the distal ends (54) and a limited length of the cantilever beam means (60).

20 Claims, 8 Drawing Sheets

TAPERED LEAD-IN INSERT FOR A COAXIAL CONTACT

BACKGROUND OF THE INVENTION

This invention relates to disposing a center receptacle contact in a coaxial plug contact, and in particular to a tapered lead-in dielectric insert for positioning a mating center contact in a coaxial contact and for insulating the center contact from the surrounding conductive shell.

Dielectric inserts used to position a center receptacle contact in a coaxial plug contact have typically extended substantially through the entire length of the center receptacle contact, or if terminated short of the end of the coax plug contact provided no lead-in for the center contact of a mating coax contact.

There is disclosed in U.S. Pat. No. 3,699,504 an open barrel coaxial cable terminal having cantilever spring arms, with the terminal freely received within a dielectric sleeve partially lining the recess to prevent grounding of the terminal against a sidewall of the recess.

It would be desirable to have a first dielectric insert to position a center coaxial contact and a second dielectric insert to provide a lead-in for the center contact of a mating coaxial contact with allowance for air to surround the center contact to maximize impedance of the coaxial contact.

SUMMARY OF THE INVENTION

In accordance with the present invention, a coaxial contact that may be used as a stand alone contact or in conjunction with a dielectric housing, has an electrically conductive shell defining a substantially cylindrical forward end. A center contact for termination to a center conductor of a coaxial cable is disposed concentrically in the shell and isolated therefrom. The center contact has a mating portion defining cantilever beam means which extend to respective distal ends. A dielectric insert having a forward portion and a rearward portion is secured in the shell proximate the forward end. The insert has an axial bore therethrough for receiving a center pin contact of a mating connector. The rearward portion of the insert receives the distal ends and a limited length of the cantilever beam means within the bore therein.

DESCRIPTION OF THE PREFERRED EMBODIMENT

Figure 1:
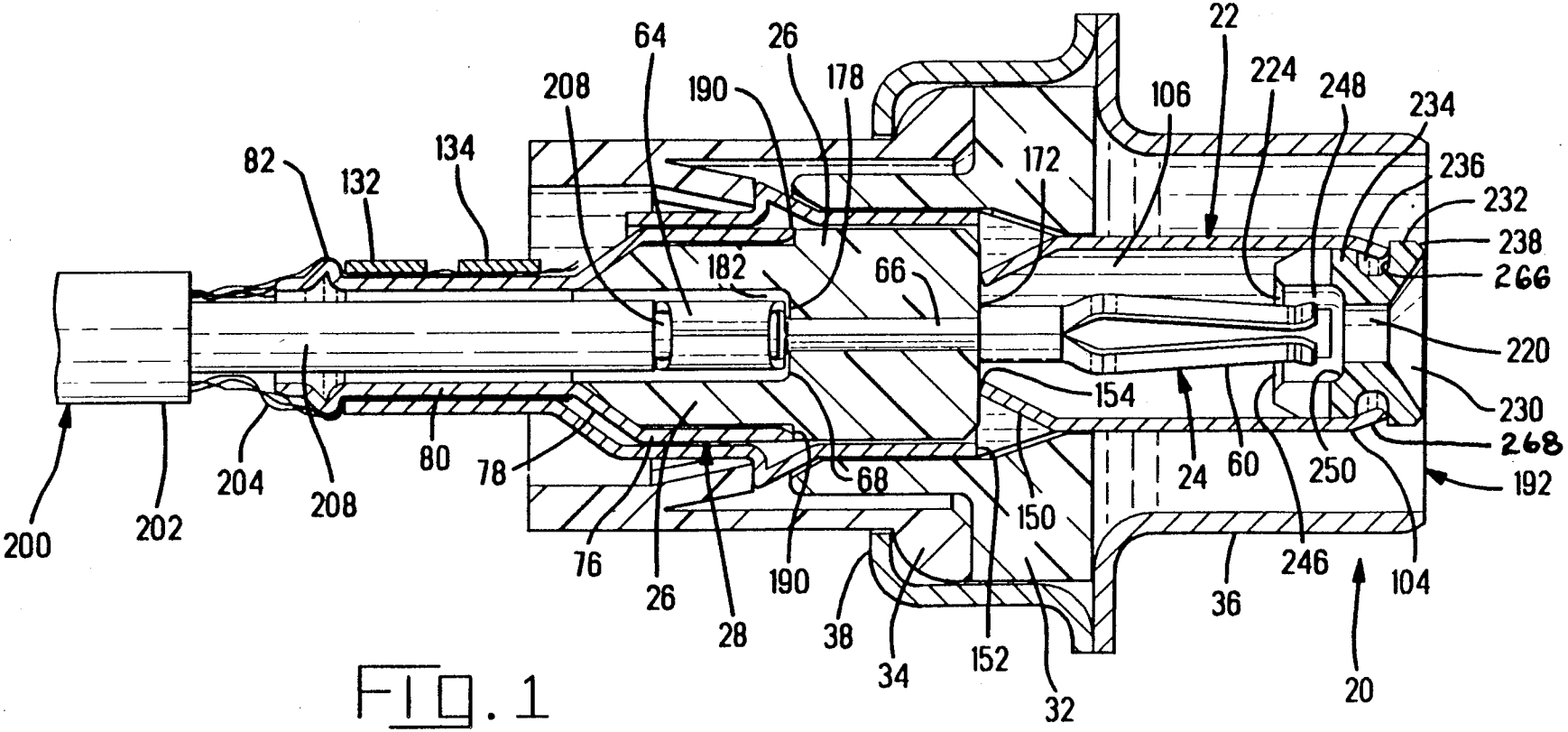
FIG. 1 is a partial cross section through a plug connector showing a center coaxial contact secured in a plug coaxial contact with the distal ends of cantilever beams received partially within a tapered lead-in insert dielectric insert, in accordance with the present invention.

A connector 20 is shown in FIG. 1 including a plug coaxial contact 22 having a center contact 24 secured therein by a dielectric insert 26 with the distal ends 54 of cantilever beams 60 received partially within tapered lead-in insert 192 in accordance with the present invention. Coaxial plug contact 22 also includes a ferrule 28 and plug shell 104. Connector 20 includes front and rear dielectric housing members 32,34 and, if shielded, includes front and rear shell means 36,38. Coaxial plug contact 22 may be used in conjunction with connector 20 or alone. When used in conjunction with connector 20, contact 22 may be secured in connector 20 in accordance with the concurrently filed U.S. patent application Ser. No. 07/531,212, entitled "Snap-In Retention System For Coaxial Contact," the disclosure of which is hereby incorporated by reference, or any other known method.

Figure 3:
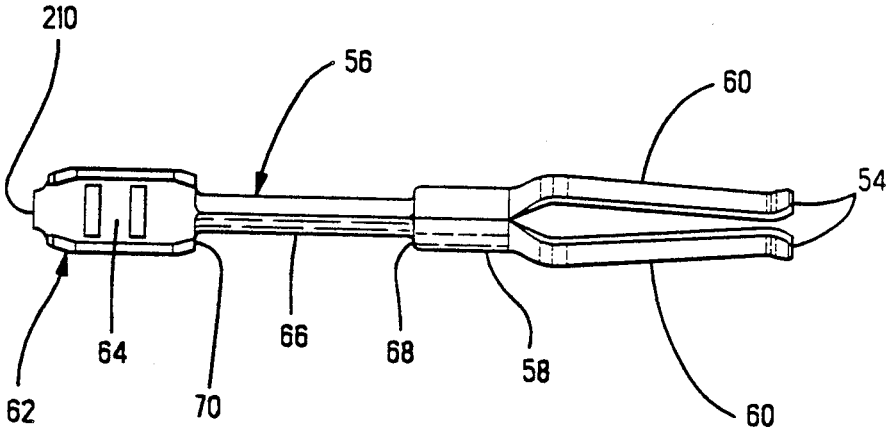
FIG. 3 is a receptacle center contact.

Center contact 24 shown in FIG. 1 is a receptacle contact 56. A top view of an unterminated receptacle contact 56 is shown in FIG. 3. Contact 56 is typically stamped and formed from phosphor bronze stock having a cylindrical barrel 58 formed with cantilever beams 60 extending therefrom for receiving therebetween mating portion of a pin contact. Contact 56 also includes a terminating portion 62 in the form of a crimped barrel 64, and a reduced diameter shank 66 between the cylindrical barrel and crimp barrel. The differential diameter between shank 66 and cylindrical barrel 58 defines a rearwardly facing annular shoulder 68. The difference in diameter between shank 66 and barrel 64, when crimped, defines forwardly facing shoulder 70. Thus, shank 66 extends between shoulders 68 and 70.

Figure 4:
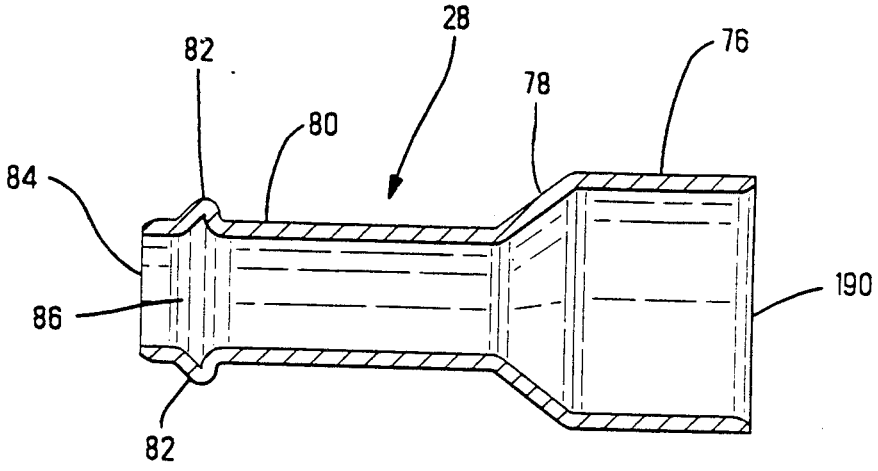
FIG. 4 is a ferrule for use with a coaxial contact.

A drawn conductive ferrule 28 is shown in FIG. 4 for a coaxial cable. While the ferrule in the preferred embodiment is a drawn member, such a ferrule could also be stamped and formed. Ferrule 28 is electrically conductive and typically manufactured from brass. Ferrule 28 has a large diameter forward end 76, a tapered section 78 and a cylindrical section 80. The cylindrical section has an annular ridge 82 of larger diameter than the respective cylindrical section proximate the free edge 84, with free edge 84 defining a cable entry 86.

Figure 5:
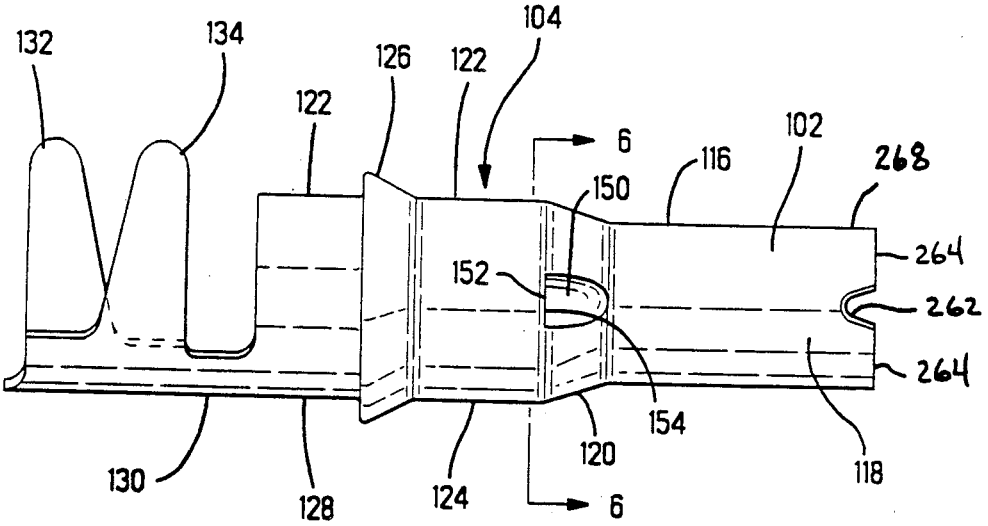
FIG. 5 is a side view of the plug shell.

A side view of plug shell 104 is shown in FIG. 5. Plug shell 104 has a hollow, generally cylindrical shape. Shell 104 is typically stamped and formed of brass. Shell 104 has a reduced diameter forward end 116 the outside surface 118 of which is typically gold plated. Forward end 116 is sized such that the outer diameter is receivable within the forward end of a receptacle coaxial contact. Forward end 116 extends rearward to a transition region 120 of conical shape that tapers to a larger diameter section 122 that may have a retention section 126 therein. Rear section 122 includes ferrule receiving section 128 and insert receiving section 124 which have substantially the same inside diameter in the preferred embodiment. Ferrule receiving section 128 has an inside diameter sized to receive the forward end 76 of ferrule 28 as best seen in FIG. 1. A portion of ferrule receiving section 128 extends rearward forming extension 130 with crimp tabs 132 and 134 extending upwardly therefrom.

Figure 6:
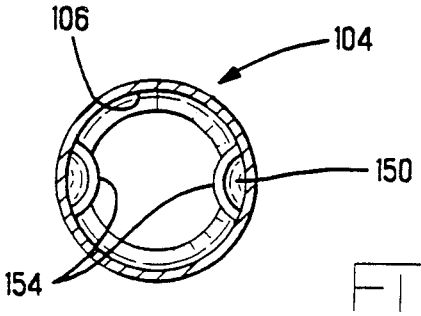
FIG. 6 is a cross-sectional view of the plug shell of FIG. 5 taken along lines 6—6 in FIG. 5.

Plug shell 104 has stops 150 formed from a shear line segment 152. Stop 150 is formed inwardly relative to shell 104 resulting in an arcuate stop shoulder 154, best seen in FIG. 6, which positions the leading surface 172 of insert 26 upon insertion into shell 104 and prevents over-insertion of insert 26.

Figure 2:
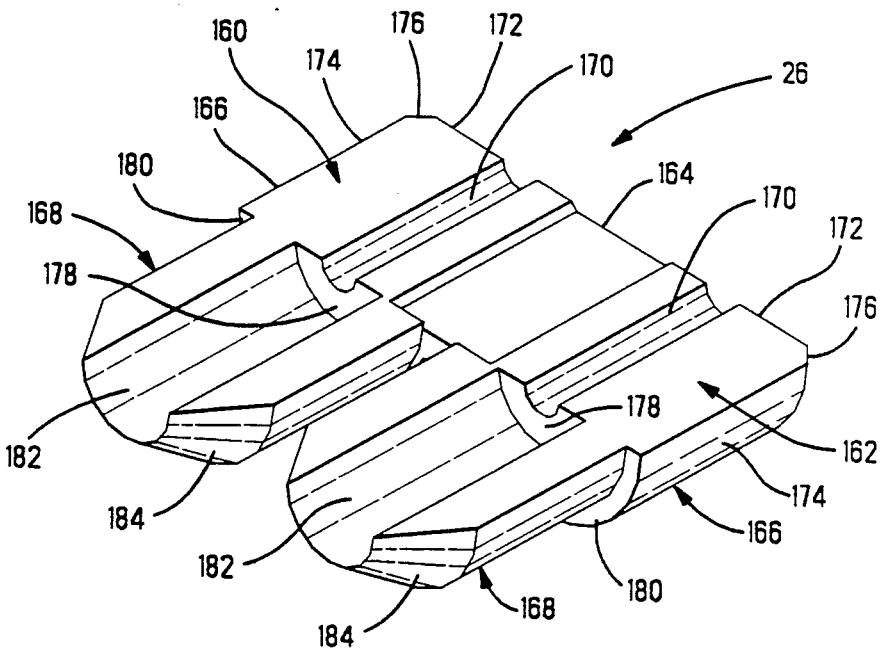
FIG. 2 shows a dielectric insert for a coaxial contact.

A two-piece dielectric insert is shown in FIG. 2. Two-piece dielectric insert 26 is comprised of two substantially identical halves 160,162. Halves 160,162 in the preferred embodiment are molded of polyolefin and are hingedly interconnected by web 164. Each half has a forward portion 166 and a rearward portion 168. Each forward portion is substantially semi-cylindrical having a semi-cylindrical channel 170 coaxially disposed therein. Forward surface 172 is semi-annular in shape and engages a stop shoulder 154 upon insertion of insert 26 into shell 104. The edge of surface 172 along semi-cylindrical side wall 174 may be beveled 176 to facilitate entry of insert 26 into a shell. The rear of forward portion 166 is defined by inner semi-annular surface 178 concentrically disposed about channel 170 and outer semi-annular surface 180 also concentrically disposed about channel 170.

The spacing or distance between surfaces 172 and 178 is substantially the same spacing or distance between shoulders 68 and 70 of receptacle contact 56 (see FIG. 3). The radius of semi-cylindrical channel 170 is substantially the same as or slightly smaller than the radius of shank 66 of a receptacle contact 56. When halves 160 and 162 are positioned over each other in the absence of web 164 or when the two halves are folded about web 164, the two forward portions 166 form a cylindrical structure with the two semi-cylindrical channels 170 forming a centrally located cylindrical bore therethrough.

Rearward portion 168 extends from and is integral with forward portion 160 of each half 160,162 between inner semi-annular surface 178 and outer semi-annular surface 180. Rearward portion 160 is substantially semi-cylindrical having a semi-cylindrical channel 182 coaxially disposed therein and extending from semi-annular surface 178 rearward. The radius of channel 182 is typically larger than the radius of channel 170 as channel 170 accommodates the shank of a center contact 24 while channel 182 accommodates the crimped barrel of a center contact 24. When halves 160 and 162 are folded about web 164 or positioned over each other in the absence of web 164, rearward portions 168 form a cylindrical structure with two semi-cylindrical channels 182 forming a centrally located cylindrical bore therethrough. Rearward portion 168 may be beveled 184 at the trailing edge to be received in a tapered portion of a ferrule 28.

The outside diameter of the rearward portion, when halves 160,162 are folded about web 164, is sized to be closely received within the forward end 76 of ferrule 28 with the leading edge 188 of ferrule 28 abutting semi-annular surfaces 180 in the assembled contact to position and secure insert 26 in the desired location within shell 104. Thus, arcuate stop shoulders 154 provide a forward stop for insert 26 while surfaces 190 provide a rear stop for the insert. Insert 26 may be in accordance with concurrently filed U.S. patent application Ser. No. 07/531,192, entitled "Foldable Dielectric Insert For A Coaxial Contact" the disclosure of which is hereby incorporated by reference, or any other known insert.

Plug contact 22 comprises a center contact 24, in the form of receptacle contact 56, a dielectric insert 26, a shell 104, a ferrule 28 and an insulated tapered lead-in insert 192. Other than insert 192, in the preferred embodiment, air is the only dielectric separating center contact 24 from or 104 forward of surface 172 of insert 26 where the function of insert 26 is to position and electrically isolate contact 24 coaxially within shell 104.

Figure 7:
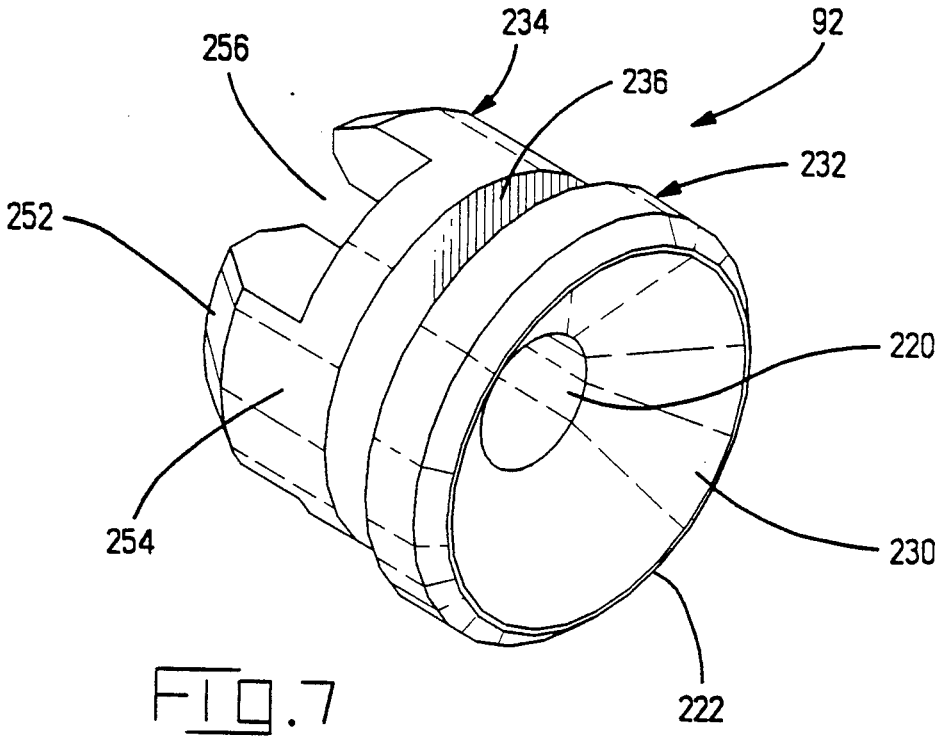
FIG. 7 is a front perspective view of the tapered lead-in insert.
Figure 8:
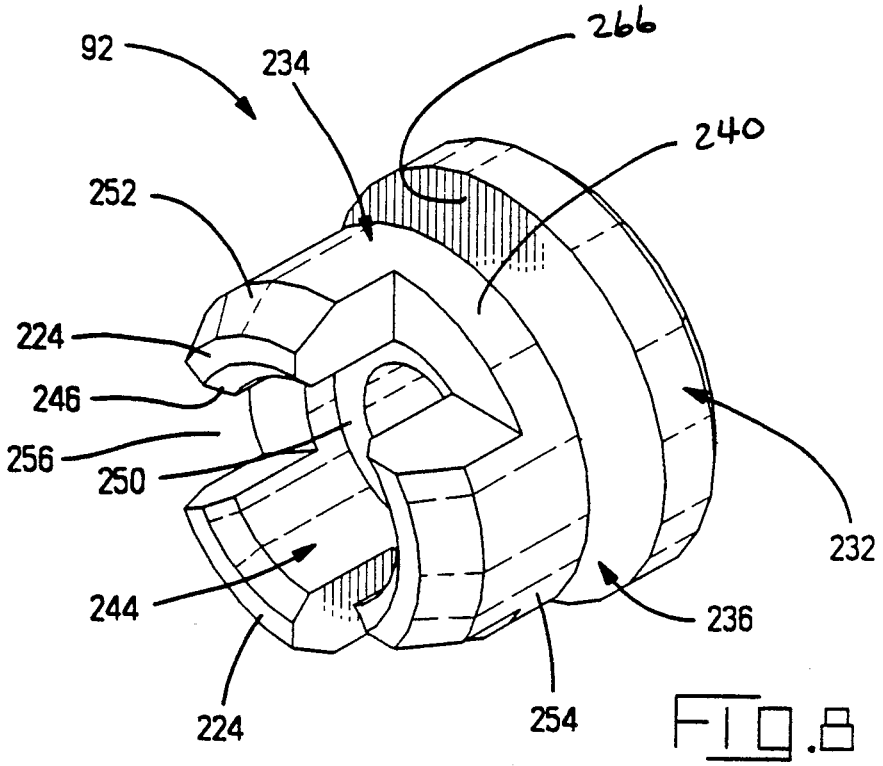
FIG. 8 is a rear perspective view of the tapered lead-in insert.

Tapered lead-in insert 192 is a dielectric insert as best seen in cross-section in FIG. 1, a front perspective view in FIG. 7 and a rear perspective view in FIG. 8. In the preferred embodiment, insert 192 is molded as a single member of a material having a low dielectric constant, such as polyolefin. Insert 192 provides a second dielectric member in contact 22 and is substantially cylindrical in shape having a central bore 220 extending from front surface 222 through insert 192 to rear surface 224. Bore 220 is sized to receive the center pin contact 226 of a mating contact 228 (see FIG. 11).

Tapering inwardly from front surface 222 to bore 220 is tapered lead-in 230, which in the preferred embodiment is conical in shape. Insert 192 includes a forward portion 232 and a rear portion 234 separated by annular recess 236. Forward portion 232 may be beveled 238 at the perimeter of front surface 222 to assist in alignment with contact 228 during mating.

The outside diameter of forward portion 232 in the preferred embodiment is slightly larger than the outside diameter of rear portion 234. The outside diameter of rear portion 234 is sized to be received within forward end 116 of contact 22. The outside diameter of forward portion 232 is sized to be substantially the same as or slightly smaller than the outside diameter of forward end 116 to facilitate being received within the shell of contact 228 during mating.

Rear portion 234 includes an annular section 240 adjacent annular recess 236 and a castellated flange portion 242 extending rearwardly therefrom. Enlarged bore 244 coaxial with bore 220 extends into at least a portion of flange portion 242. Bore 244 is beveled 246 around the periphery at rear surface 224 to facilitate insertion of the ends of cantilever beams 60. Bore 244 extends to a depth to accommodate the distal ends of cantilever beams 60 of center contact 56 and allows a gap 248 (FIG. 1) between the distal ends 54 and annular surface 250 which defines the differential radii between bores 220 and 244. Rear portion 234 is beveled 252 around the intersection of outer cylindrical surface 254 and rear surface 224 to facilitate insert 192 coaxially aligning with the inner surface 106 of forward end 116 of shell 104 during insertion thereinto.

Castellated flange 242 has interruptions or air gaps 256 spaced therearound with the air gaps extending from bore 244 through rear portion 234 to outer cylindrical surface 254. Thus, air surrounds the center contact as the insulator between the center contact, specifically cylindrical barrel 58 and beams 60, and the inner surface 106 of shell 104 from surface 172 of insert 26 to rear surface 224 of insert 192. Furthermore, air gaps 256 permit air to be the insulator through the region of the air gaps between that portion of the cantilever beams received within flange portion 242 and the inner surface 106 of shell 104. In the absence of another dielectric material through the region of the air gaps, air allows the impedance of contact 22 to be maximum.

Projections 258 defined in flange 242 by air gaps 256 are positioned between cantilever beams 60 and inner surface 106. In the preferred embodiment there are three projections 258. Bore 244 defines the inner surface 260 of each projection. Distal ends 54 of beams 60 are received within insert 192 and more specifically, bore 244 as best seen in FIG. 1. Projections 258 extend over only a limited portion of beams 60 with air separating the center contact from inner surface 106 of shell 104 rearward from surface 224 to surface 172 of insert 26. Beams 60 are spaced from surfaces 260 when there is not a pin contact 226 received between beams 60 and also under normal conditions when there is a pin received between beams 60. Projections 258, specifically inner surfaces 260 thereof, define radially outward stops that provide an anti-overstress function to limit deflection of beams 60 should a pin contact not axially aligned with center contact 24 be received between beams 60. The castellated flange provides the advantage of having insert 192 provide a lead-in for a pin contact of a mating coax contact, thereby providing an alignment capability yet simultaneously having an anti-overstress feature and some air surrounding the distal ends of the cantilever beams to maximize the impedance of contact 22. In this manner, coaxial contact 22 is designed to perform at a predetermined performance level in a 75 ohm application.

Insert 192 is typically secured to shell 104 prior to shell 104 being positioned over subassembly 212. A plurality of notches 262 are disposed in the periphery of leading edge 264 of shell 104. Insert 192 is axially aligned with forward end 116 of shell 104. Shell 104 and insert 192 are moved axially toward each other such that rear portion 234 is received within forward end 116. Due to forward portion 232 being slightly larger in diameter than rear portion 234, when insert 192 is received in forward end 116 a predetermined depth, leading edge 264 engages a sidewall 266 of annular recess 236. The forward end 268 of end 116 is crimped into annular recess 236, facilitated by notches 262, to be of a smaller diameter than rear portion 234 thereby securing insert 192 to shell 104 as best seen in FIG. 1.

Coaxial contact 22 may be assembled and terminated to a coaxial cable manually or using automated assembly equipment. The assembly procedure will be described with reference to the sequence of FIGS. 9A–F.

Figure 9A:
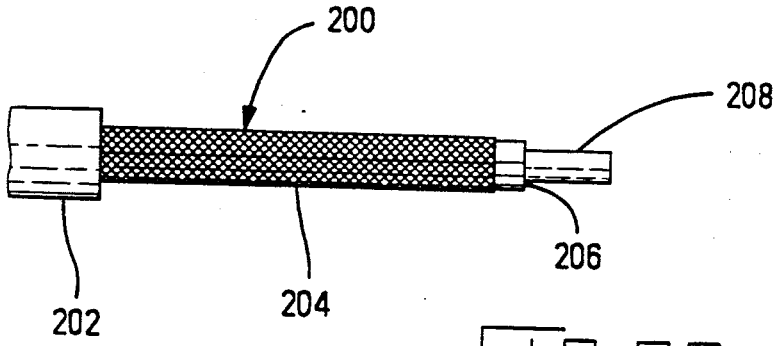
FIGS. 9A–F are a sequence of Figures showing the assembly of coaxial contact.
Figure 9B:
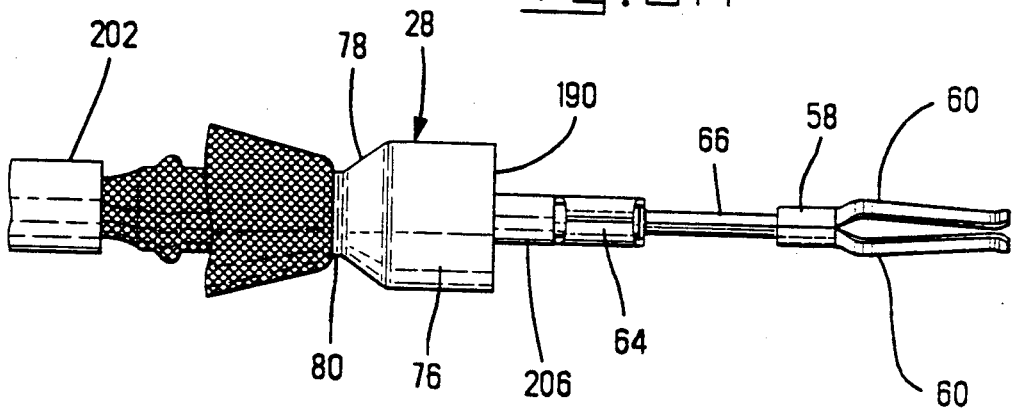

FIG. 9A shows a coaxial cable 200 for terminating to a coaxial contact 22 as described herein. The jacket 202, braid 204 and dielectric 206 of the cable have been removed to expose a length of approximately 6.75 mm of the center conductor 208. Further, jacket 202 has been removed to expose a length of approximately 25 mm of the braid. The stripped center conductor 208 is laid into the open crimp barrel 64 of a center contact 24. Preferably, the cable dielectric 206 is butted against the rear end 210 of the crimp barrel. The center conductor is crimped in the crimp barrel thereby securing the center conductor to the coax center contact to complete a mechanical and electrical connection therebetween. The coax cable braid 204 is splayed and the terminated center contact 24 is passed into cable entry 86 and through a ferrule 28. Alternatively, it may be stated that the ferrule is passed over the center contact.

The ferrule is slid axially along the cable, with cylindrical section 80 between the cable dielectric 206 and the braid 204 to a position with the leading edge 190 beyond the crimp barrel of the center contact as shown in FIG. 9.

Figure 9C:
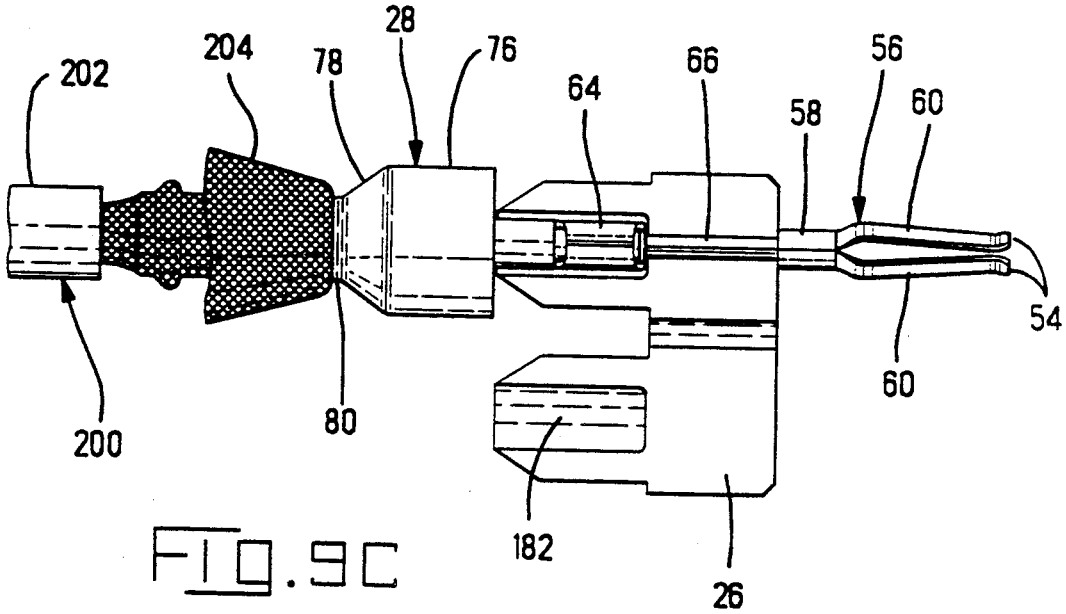

As shown in FIG. 9C, the center contact 24 is positioned in channels 170,182 of one half 160 or 162. The other half 162 or 160 is positioned over the center contact, or if web 164 is present the other half is folded at web 164 around the center contact.

The forward end of the insert is held to maintain the center contact in position while the ferrule is slid axially along the cable toward the end of the mating contact such that rearward portions of the insert are received within forward end 76 of the ferrule until leading edge 190 engages outer semi-annular surfaces 180. In this position, insert 26 is prevented from being removed inadvertently. Insert 26 will not slide axially toward the unterminated end of center contact 24 due to the forward surfaces 172 engaging shoulders 52 or 68. In order to be removed, the two halves must be separated from each other to allow channels 170 to pass over shoulders 52 or 68. Thus, with insert 26 partially within ferrule 28, the center contact is held centered in insert 26 which in turn is centered within the ferrule.

Figure 9D:
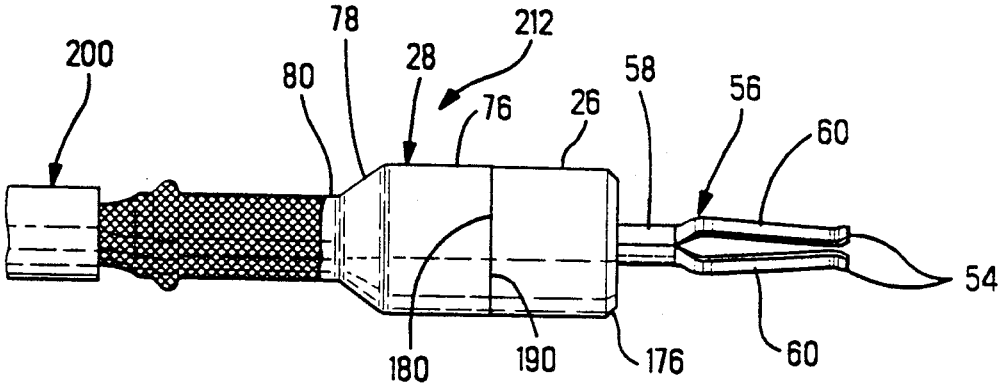

The cable braid 204 is then smoothed out to surround the smaller diameter cylindrical section 80 of the ferrule as shown in FIG. 9D.

Figure 9E:
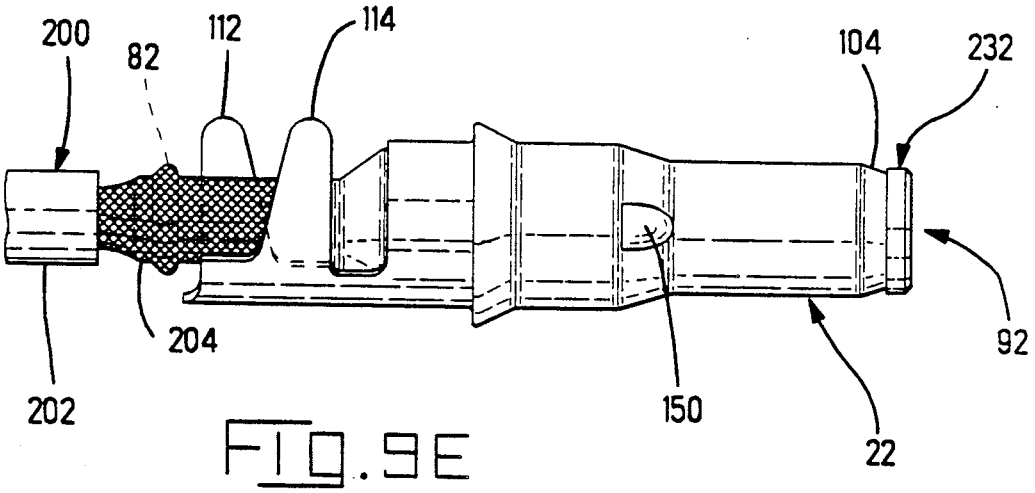

Insert 192 is preassembled to shell 104. The above subassembly 212 is then inserted into the ferrule receiving end of a shell 104 with distal ends 54 of beams 60 received in bore 244 and forward surface 172 engaging forward stops 150, specifically the arcuate stop shoulders 154 as shown in FIG. 9E. If leading ends 54 do not pass into bore 244 and stubs, it is known that rework is required. This properly positions center contact 56, insert 26, ferrule 28 and subassembly 212 within shell 104.

Figure 9F:
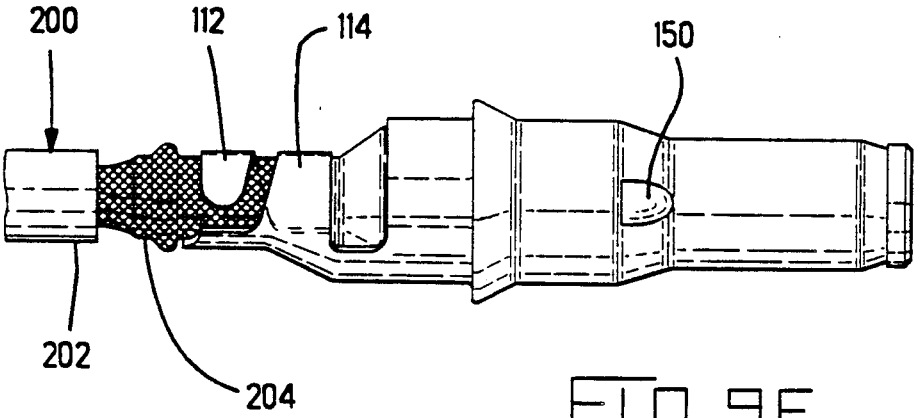

As shown in FIG. 9F, tabs 132,134 are then crimped over the braid to secure the shell to the subassembly and to complete an electrical path from shell 104 to braid 204. Crimping the tabs completes the assembly of the coax contact with the crimped tabs securing all parts of the connector together. This provides a strain relief through the braid to the outer shell rather than through the center contact. The crimped tabs are between the annular ridge 82 and forward end 76 with the larger diameter of annular ridge 82 preventing the crimped tabs from otherwise sliding off cylindrical section 80. The completed coaxial contact 22 may be inserted into dielectric housing means 34,36 if desired.

Figures 10, 11:
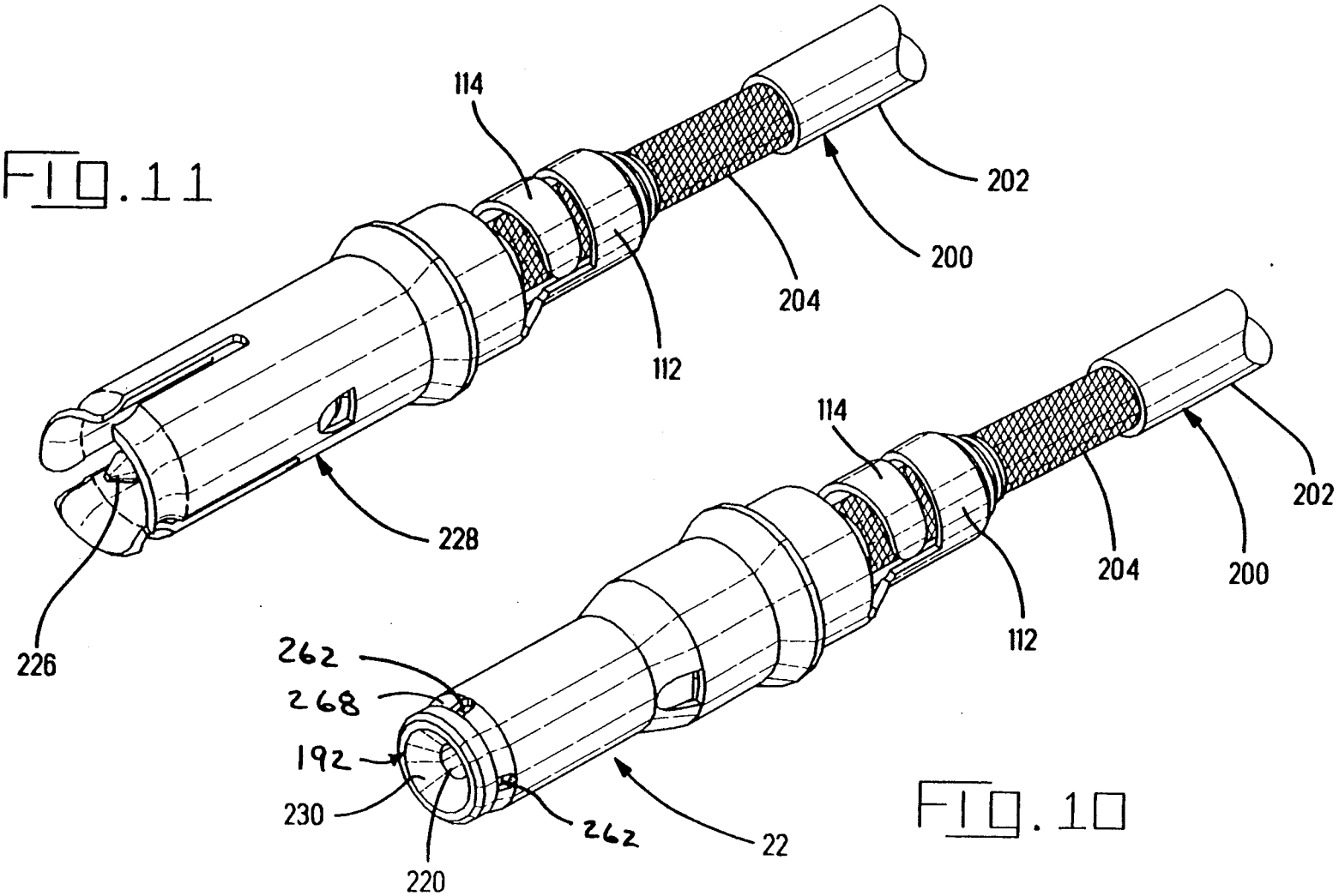
FIG. 10 shows a coax contact in accordance with the present invention terminated to a coaxial cable.
FIG. 11 shows a complementary coax contact for mating with the coax contact of the present invention.
Figure 12:
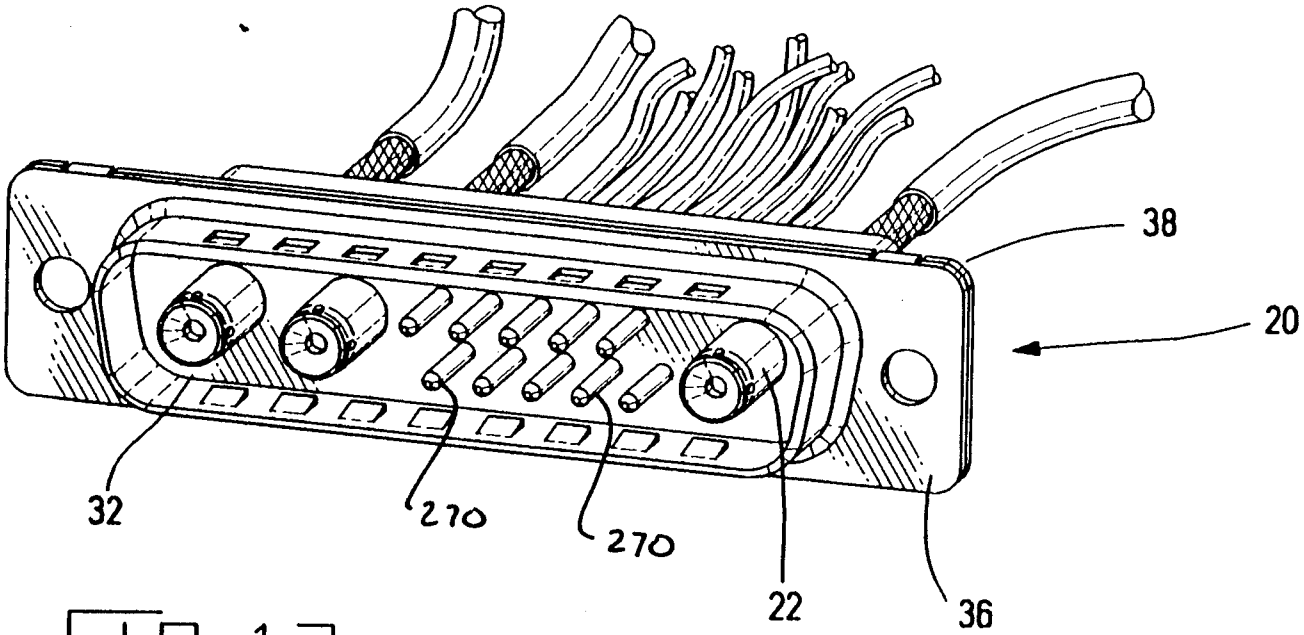
FIG. 12 shows a front perspective view of a coax mix connector including the coax contact of the present invention.

FIG. 10 shows a front perspective view of a coax terminal 22. FIG. 11 shows a perspective view of a mating contact 228. FIG. 12 shows a front perspective view of a coax mix connector including contact 22 and a plurality of non-coax contacts 270 secured in the connector housing.

While the preferred embodiment has been described employing a crimp termination of the center conductor to the center contact and a crimp to secure the shell to the ferrule, the invention is not limited thereto.

I claim:

1. A coaxial contact, comprising:

an electrically conductive shell defining an open forward end;

a center contact for termination to a center conductor of a coaxial cable, the center contact having a mating portion defining cantilever beam means, said cantilever beam means extending to respective distal ends, said center contact disposed concentrically in said shell and isolated therefrom; and a dielectric insert having a forward portion and a rearward portion, said insert secured in the shell proximate the open forward end, the insert having an axial bore therethrough for receiving a center pin contact of a mating connector, the rearward portion receiving the distal ends and a limited length of said cantilever beam means within said bore.

2. A coaxial contact as recited in claim 1, wherein the forward portion tapers from proximate the periphery thereof to the bore, defining a tapered lead-in to guide the pin toward the bore during alignment and mating.

3. A coaxial contact as recited in claim 1, wherein the bore through at least a limited length of said rearward portion is enlarged in diameter to receive said cantilever beam means.

4. A coaxial contact as recited in claim 1, wherein the rearward portion extends to a rear surface, the insert being tapered around the periphery of the rear surface to facilitate passing the insert into the shell during fabrication.

5. A coaxial contact as recited in claim 1, wherein the rearward portion extends to a rear surface, the insert being tapered at the rear surface around the periphery of the bore to facilitate insertion of the cantilever beam means into the bore.

6. A coaxial contact as recited in claim 1, wherein the insert further comprises an annular recess, said forward end crimped into the recess to secure the insert in the shell.

7. A coaxial contact as recited in claim 6, further comprising notches in the forward end of the shell to facilitate crimping.

8. A coaxial contact as recited in claim 1, wherein the rearward portion is castellated defining projections around the periphery of the rearward portion with air gaps therebetween.

9. A coaxial contact as recited in claim 8, wherein the projections are positioned around the periphery of the rearward portion proximate the cantilever beam means and provide anti-overstress stops for the cantilever beam means.

10. A coaxial contact, comprising:

an electrically conductive shell defining an open forward end;

a center contact for termination to a center conductor of a coaxial cable, the center contact having a mating portion defining cantilever beam means, said cantilever beam means extending to respective distal ends;

a first dielectric insert for securing the center contact in the shell electrically isolated therefrom; and a second dielectric insert having a forward portion and a rearward portion, said second insert secured in the shell proximate the forward end, said second insert having an axial bore therethrough for receiving a center pin contact of a mating connector.

11. A coaxial contact as recited in claim 10, wherein the bore through at least a limited length of said rearward portion is enlarged in diameter to receive said cantilever beam means.

12. A coaxial contact as recited in claim 10, wherein the forward portion of said second insert tapers from proximate the periphery thereof to the bore thereby defining a tapered lead-in to guide a pin toward the bore during alignment and mating.

13. A coaxial contact as recited in claim 12, wherein the distal ends and a limited length of the cantilever beam means are received within said bore.

14. A coaxial contact as recited in claim 12, wherein the forward portion of said second insert tapers from proximate the periphery thereof to the bore thereby defining a tapered lead-in to guide a pin toward the bore during alignment and mating.

15. A coaxial contact as recited in claim 10, wherein the rearward portion of said second insert is castellated defining projections around the periphery of the rearward portion with air gaps therebetween.

16. A coaxial contact as recited in claim 15, wherein the projections are positioned around the periphery of the rearward portion between the cantilever beam means and the shell, whereby the projections define anti-overstress stops for the cantilever beam means.

17. A coax mix connector, comprising:

an insulative housing for receiving and securing at least one coax contact and at least one non-coax contact;

a coaxial contact received and secured in said housing, said coaxial contact having an electrically conductive shell defining an open forward end, a center contact for termination to a center conductor of a coaxial cable, the center contact having a mating portion defining cantilever beam means, said cantilever beam means extending to respective distal ends, said center contact disposed concentrically in said shell and isolated therefrom; and a dielectric insert having a forward portion and a rearward portion, said insert secured in the shell proximate the forward end, the insert having an axial bore therethrough for receiving a center pin contact of a mating connector, the rearward portion receiving the distal ends and a limited length of said cantilever beam means within said bore.

18. A coax mix connector as recited in claim 17, wherein the bore through at least a limited length of said rearward portion is enlarged in diameter to receive said cantilever beam means.

19. A coax mix connector as recited in claim 17, wherein the rearward portion of the insert is castellated defining projections around the periphery of the rearward portion with air gaps between the projections.

20. A coax mix connector as recited in claim 19, wherein the projections are positioned around the periphery of the rearward portion between the cantilever beam means and the shell, whereby the projections define anti-overstress stops for the cantilever beam means.

* * * * *